US008826571B2

(12) United States Patent
Rutherford

(10) Patent No.: US 8,826,571 B2
(45) Date of Patent: Sep. 9, 2014

(54) SHOE ASSEMBLY FOR STRENGTH TRAINING AND FITNESS EXERCISE

(76) Inventor: Ralph A. Rutherford, Gaithersburg, MD (US)

( * ) Notice: Subject to any disclaimer, the term of this patent is extended or adjusted under 35 U.S.C. 154(b) by 808 days.

(21) Appl. No.: 12/768,175

(22) Filed: Apr. 27, 2010

(65) Prior Publication Data

US 2011/0258885 A1 Oct. 27, 2011

(51) Int. Cl.

| | |
|---|---|
| ***A43B 3/00*** | (2006.01) |
| ***A43B 13/14*** | (2006.01) |
| ***A43B 9/00*** | (2006.01) |
| ***A43B 5/00*** | (2006.01) |
| ***A43B 7/00*** | (2006.01) |
| ***A43B 13/12*** | (2006.01) |
| ***A43B 13/38*** | (2006.01) |
| ***A43B 23/22*** | (2006.01) |
| ***A43C 11/00*** | (2006.01) |
| ***A63B 21/00*** | (2006.01) |
| *A63B 21/055* | (2006.01) |

(52) U.S. Cl.

CPC . *A43B 9/00* (2013.01); *A43B 13/14* (2013.01); *A43B 5/00* (2013.01); *A43B 7/00* (2013.01); *A43B 3/00* (2013.01); *A43B 13/12* (2013.01); *A43B 13/38* (2013.01); *A43B 23/22* (2013.01); *A43C 11/00* (2013.01); *A63B 21/0557* (2013.01); *A63B 21/143* (2013.01)

USPC ..... 36/136; 36/25 R

(58) Field of Classification Search

CPC ..... A43B 5/00; A43B 13/14; A43B 7/00; A43B 13/12; A43B 13/122; A43B 13/125; A43B 19/005; A63B 21/143; A43C 11/00; A43C 19/00

USPC ..... 36/132, 136, 113, 114, 15, 100, 101, 36/115, 134, 137, 138, 133, 130, 25 R, 83, 36/79, 122–124, 312, 43–44; 482/79, 124, 482/92–96, 121–123, 57, 126

See application file for complete search history.

(56) References Cited

U.S. PATENT DOCUMENTS

| | | | | |
|---|---|---|---|---|
| 771,938 | A | 10/1904 | Ruhl | |
| 2,072,785 | A * | 3/1937 | Wulff | 36/11.5 |
| 2,114,790 | A | 4/1938 | Venables | |
| 2,478,664 | A * | 8/1949 | Morrow et al. | 36/31 |
| 2,522,515 | A | 9/1950 | Ruth | |
| 2,760,774 | A | 8/1956 | Perez | |
| 2,835,249 | A | 5/1958 | Benny | |
| 3,343,836 | A | 9/1967 | James, Jr. | |
| 3,477,426 | A | 11/1969 | Wincheski | |
| 3,487,829 | A | 1/1970 | Barnett | |
| 3,785,646 | A | 1/1974 | Ruskin | |
| 4,222,182 | A | 9/1980 | Sears | |
| 4,286,397 | A * | 9/1981 | Booty | 36/132 |
| 4,334,367 | A | 6/1982 | Salomon | |
| 4,573,457 | A | 3/1986 | Parks | |
| 4,596,387 | A | 6/1986 | Roberts | |

(Continued)

*Primary Examiner* — Ted Kavanaugh

(74) *Attorney, Agent, or Firm* — Blank Rome LLP

(57) ABSTRACT

Insole constructions for shoes including flexible components that allow for the connection of attachments having various devices are described. The insole constructions provide a supported attachment point for various components while not compromising the flexibility of the shoe. The insole constructions allow for attachment of devices at the heel, toe or sides of the shoe. Devices for attaching to shoes having the insole construction are also described, along with apparatuses for use with shoes having the insole construction.

21 Claims, 4 Drawing Sheets

(56) References Cited

U.S. PATENT DOCUMENTS

| | | | | | |
|---|---|---|---|---|---|
| 4,709,921 | A | | 12/1987 | Valuikas et al. | |
| 4,728,103 | A | | 3/1988 | Fulton | |
| 4,756,095 | A | | 7/1988 | Lakic | |
| 4,930,233 | A | | 6/1990 | Provence | |
| 4,936,028 | A | * | 6/1990 | Posacki | 36/15 |
| 4,948,117 | A | | 8/1990 | Burke | |
| 5,094,231 | A | | 3/1992 | Rosen | |
| 5,186,701 | A | | 2/1993 | Wilkinson | |
| 5,241,762 | A | | 9/1993 | Rosen | |
| 5,263,916 | A | | 11/1993 | Bobich | |
| 5,267,930 | A | | 12/1993 | Henes | |
| 5,372,565 | A | | 12/1994 | Burdenko | |
| 5,490,823 | A | | 2/1996 | Awbrey et al. | |
| 5,511,824 | A | * | 4/1996 | Kim | 280/841 |
| 5,545,113 | A | | 8/1996 | Bobich | |
| 5,613,926 | A | | 3/1997 | Michaelson | |
| 5,624,360 | A | | 4/1997 | Wilkins | |
| 5,713,142 | A | | 2/1998 | Ahmed Fahmey El-Circy | |
| 5,782,727 | A | | 7/1998 | Pierce | |
| 5,926,975 | A | | 7/1999 | Goodman et al. | |
| 6,023,859 | A | | 2/2000 | Burke et al. | |
| 6,065,769 | A | | 5/2000 | Simonetti et al. | |
| 6,105,283 | A | | 8/2000 | Park | |
| 6,341,434 | B1 | * | 1/2002 | Yeh | 36/132 |
| 6,436,012 | B1 | | 8/2002 | Naville | |
| 6,601,321 | B1 | | 8/2003 | Kendall | |
| 6,634,993 | B1 | | 10/2003 | Morr | |
| 6,875,135 | B2 | | 4/2005 | Tracy, Sr. | |
| 7,044,896 | B2 | | 5/2006 | Hetrick | |
| 7,082,700 | B2 | | 8/2006 | Meschan | |
| 7,087,003 | B1 | | 8/2006 | Katterjohn | |
| 7,337,562 | B2 | | 3/2008 | Kim | |
| 7,794,368 | B2 | * | 9/2010 | Rutherford | 482/79 |
| 2004/0035025 | A1 | * | 2/2004 | Choi | 36/132 |
| 2004/0204302 | A1 | | 10/2004 | Flynn | |
| 2005/0039350 | A1 | | 2/2005 | Hung | |
| 2006/0117600 | A1 | * | 6/2006 | Greene | 36/9 R |
| 2006/0183609 | A1 | | 8/2006 | Flynn | |
| 2007/0060454 | A1 | | 3/2007 | Vogel | |
| 2007/0107264 | A1 | | 5/2007 | Meschter et al. | |
| 2007/0266598 | A1 | * | 11/2007 | Pawlus et al. | 36/102 |
| 2009/0107010 | A1 | | 4/2009 | Rutherford | |

* cited by examiner

SHOE ASSEMBLY FOR STRENGTH TRAINING AND FITNESS EXERCISE

FIELD OF THE INVENTION

The present invention relates to shoes which allow for the attachment of components to the shoe as well as the components themselves. More specifically, the present invention relates to a shoe having an insole construction that allows for the attachment of components to the shoe which facilitates the wearer of the shoe in performing strength training and fitness exercise.

BACKGROUND OF THE INVENTION

Most modern fitness proponents recommend a balanced and diverse exercise program for obtaining optimal fitness and wellness. Recommended exercise programs typically include elements of cardiovascular exercise, strength training and stretching to achieve better fitness, health, and weight management. Because of this, many active people participate in cross-training type exercise programs, performing many different types of exercises. Furthermore, many active or inactive people might not be able to withstand large amounts of joint pressure created by the use of conventional exercise equipment.

Popular methods of strength training include the use of elastic resistance bands and weight machines with cables attached to stacks of weights. In the use of both resistance bands and cable machines, upper body exercises are typically easily performed as the exerciser is able to grasp the resistance bands and cables with their hands. However, to effectively perform lower body strength training by these methods, the bands or cables need to be fastened somehow to the shoes of the exerciser. This may be done using loops or harnesses that fit over the shoe. However, loops and harnesses are prone to slip, which can be very dangerous during the performance of an exercise, and further require extra manipulations and equipment for attaching strength training equipment to the shoe.

U.S. Pat. No. 5,713,142 to El-Circy describes a training shoe allowing for the attachment of elastic bands directly to the shoe. However, El-Circy describes a shoe with attachment points that are preferably connected to one another with a rigid member that inhibits flexing of the shoe, or with attachment points that are secured only in the foam of the shoe midsole without any support. In the first case, the flexibility of the shoe is compromised, greatly limiting its use. In the second case, the attachment points are unsupported and are too weak to support the attachment of resistance strong enough to promote effective strength training.

As such, there remains a need in the art for the safe, simple, and effective attachment of exercise components to a shoe without compromising the performance of the shoe. In this way, the shoe can be used for a variety of exercises, saving the wearer time and money without compromising the quality of his or her exercise program.

SUMMARY OF THE INVENTION

It is an object of the present invention to provide a shoe with an insole construction having a connector for receiving an attachment that can be used for performing fitness exercise.

It is a further object of the present invention to provide a shoe with an insole construction having a flexible frame running from the toe to the heel of the shoe and one or more connectors for receiving an attachment. The frame and connectors are fused to one another in a manner that allows for maximum flexibility and strength, allowing a shoe containing the insole construction to maintain its flexibility.

It is a further object of the present invention to provide a shoe with an insole construction having one or more connectors at the toe, sides or heel of the shoe for receiving an attachment. The connectors are fused to the insole or connected to each other using flexible metal, rubber or fiber strands, allowing a shoe containing the insole construction to maintain flexibility and provide connector stability.

It is a still further object of the present invention to provide a variety of attachments having an exercise device for attaching to a shoe of the present invention. The exercise devices of such attachments include, but are not limited to, handles, eyelets, reflectors, hooks, D-rings, loops and the like.

DESCRIPTION OF THE DRAWINGS

Embodiments of the invention will be set forth in detail with reference to the drawings, in which.

DETAILED DESCRIPTION OF THE INVENTION

Figure 1:
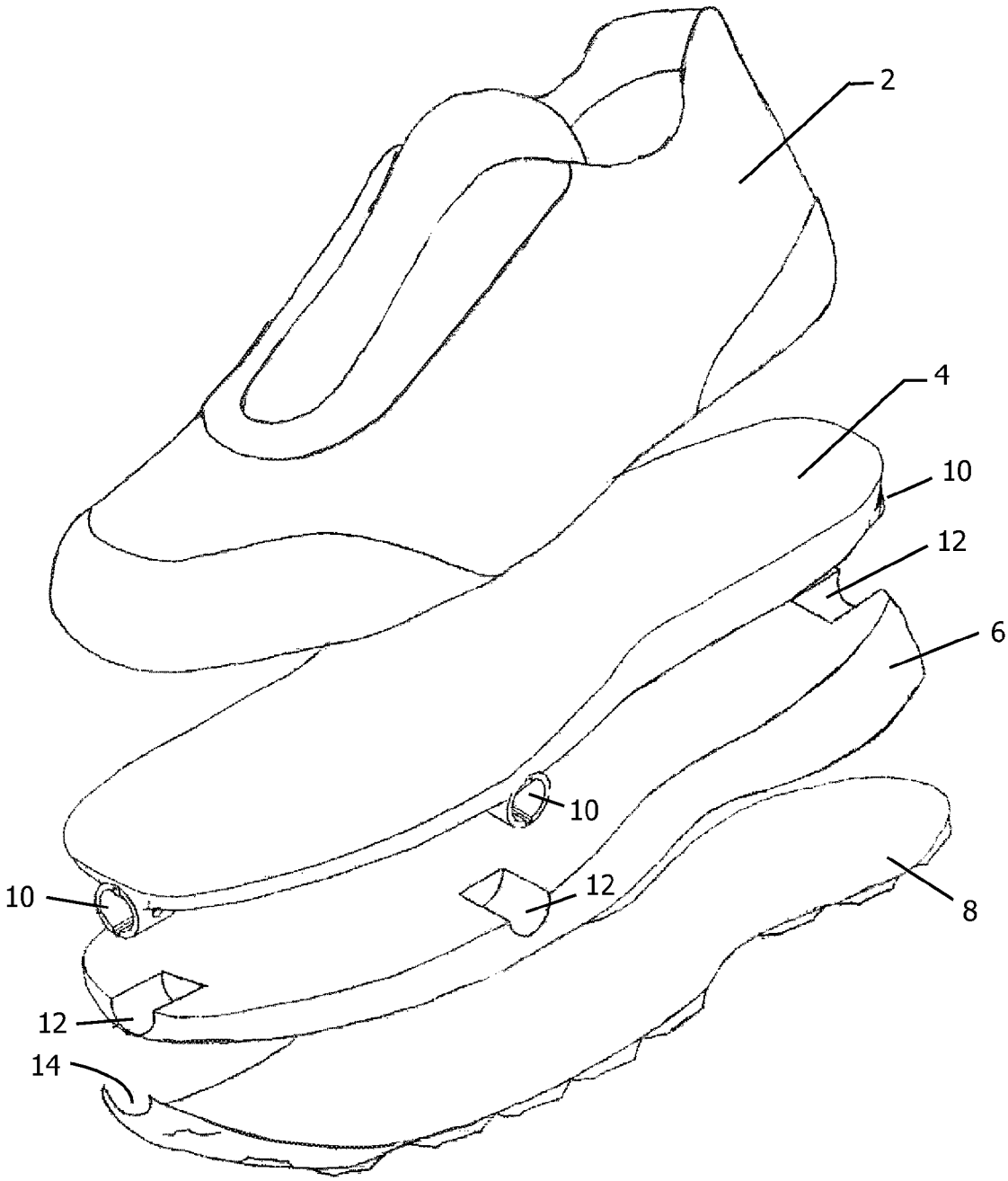
FIG. 1 is an exploded perspective view of a shoe containing an insole construction with connectors at the heel, toe and side of the shoe.

The present invention is a shoe that allows for the attachment of exercise devices to the shoe as well as the devices. The shoe of the invention has an insole construction that allows for secure attachment of devices while still maintaining the flexibility of the shoe.

The shoe of the present invention preferably functions in the same manner as a standard shoe for the specific purpose chosen, while also allowing for the attachment of attachment pieces having different functionalities. The present invention may be embodied in various types of athletic shoes, including shoes for walking, running, hiking, cross-training, tennis, court sports and outdoor sports where outsoles requiring special traction, such as cleats or spikes, may be necessary. The present invention may also be embodied in other types of shoes, such as shoes and boots for work or casual wear. The insole constructions of the present invention are designed to allow for the attachment of devices to the shoe without detracting from the original use of the shoe, e.g. a running shoe containing an insole construction of the present invention is still functional as a running shoe. Attachments are typically attached to the shoe at least securely enough to support at least the body weight of the wearer of the shoe without becoming detached, but may also be attached securely enough to support much more weight and force upon the attachment.

Certain embodiments of the invention are described in the drawings. In each of the drawings, like components are labeled with like reference numerals. However, it should be understood that there are other embodiments which are not explicitly shown in the drawings which fall within the scope and spirit of the claims set forth below.

Turning to FIG. 1, an exploded perspective view of an embodiment of the shoe of the present invention having connectors at the heel, sides and toe is shown. The shoe embodied in FIG. 1 has an upper portion 2, which may be made of synthetic material, leather, cloth or any material typically used in the construction of shoe uppers. Beneath the upper 2 is the insole 4. Typically, the insole construction of the present invention will be present inside the insole 4, as will be described. In the view of FIG. 1, only the connectors 10 of the insole construction are visible. The insole 4 may be made of any material suitable for constructing shoe insoles, including polymeric foam materials and gel materials. Below the insole 4 is the midsole 6, which may be made of any material suitable for constructing shoe midsoles, such as polymeric foam materials. The midsole 6 may have midsole recesses 12 for receiving the connectors 10 of the insole construction. Below the midsole 6 is the outsole 8, which may be made of any material suitable for constructing shoe outsoles, such as rubber. The outsole may have one or more outsole recesses 14, for receiving the connectors 10 of the insole construction.

The different layers shown in FIG. 1 may be assembled together to form a shoe using any suitable method for such assembly. For example, the different layers may be assembled with an adhesive, or by stitching layers together.

Figure 2:
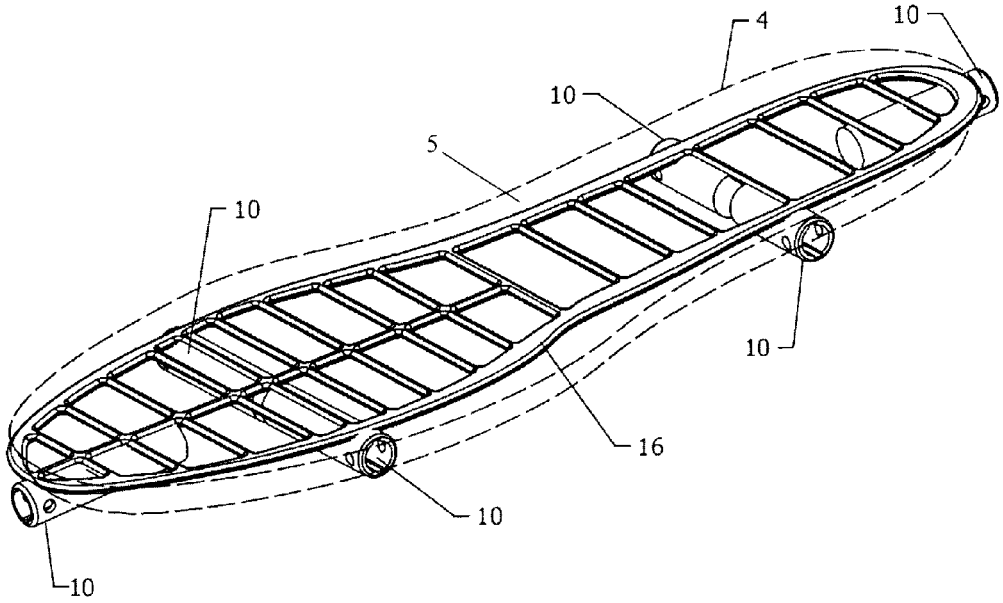
FIG. 2 is a perspective view of an assembled insole frame construction with connectors at the heel, toe and sides of the shoe.

Regarding FIG. 2, a perspective view of an embodiment of an insole 4 having an interior section 5 that includes an insole frame construction 16 with connectors 10 at the heel, sides and toe of the shoe is shown. In certain embodiments of the present invention, the insole 4 is formed around the insole frame construction 16 during the construction of the insole 4. For example, if the insole 4 is formed from a liquid polymeric material, the insole frame construction 16 may already be present inside of the insole cast before the liquid polymeric material is added. In other embodiments of the present invention, the formed insole 4 may be cut or otherwise opened to allow the insole frame construction 16 to be added, after which the insole 4 may be resealed. In the embodiment shown in FIG. 2, the insole frame construction 16 has connectors 10 at the heel, toe and both sides of the shoe. However, it is also contemplated that embodiments of the present invention may have only one or more than one connector. Furthermore, it is contemplated that embodiments of the present invention may have connectors located in various locations along the shoe. This includes shoes without a connector at either or both the toe and heel and shoes with no, one or multiple connectors on each side. The frame 16, as drawn, is a one piece design and can be either stamped, cut or poured during the molding process. The cross members can be any length or width and they provide strength while at the same time allow for flexibility of the frame construction. The connectors 10 can be above, below or integrated into the frame construction. The connection between the frame 16 and the connector 10 can be made by glue, weld or during the molding process. The connector 10 can be designed in many shapes or forms, such as a plate connector, a round connector, etc.

The embodiment of FIG. 2 shows one shape of insole frame construction 16, although many other shapes are contemplated. As shown, some of the connectors 10 extend substantially parallel to the longitudinal axis of the shoe, and other connectors 10 (referred to here for clarity as "cross-connectors") extend substantially perpendicular to the longitudinal axis of the shoe.

The insole frame construction 16 of FIG. 2 has cross support members, which provide strength to the insole frame construction 16. The insole frame construction 16 of FIG. 2 has an outer peripheral frame, which defines the shape of the insole frame construction 16 and provides support for the insole frame construction 16. One or more longitudinal members may be provided which can extend through the length of the shoe from heel to toe. The longitudinal support members may run the length of the shoe to provide additional strength and support to the insole frame construction 16, and especially to provide added strength in the longitudinal direction to the longitudinally-extending connectors 10. However, the longitudinal support members need not extend the entire length of the shoe to allow for additional flexibility. The longitudinal support members extends substantially parallel to the longitudinal axis of the shoe, and at least one longitudinal support members is provided at the center of the shoe. The longitudinal support member intersects and is integral with the cross support members to lend further support to the frame 16. Each of the cross support members, the outer frame and the center support member may be of various widths or diameters and may have different cross-sectional shapes, including circular, rectangular, square and triangle shaped cross sections.

In the embodiment shown in FIG. 2, the connector 10 extends beyond the insole construction 16 so that the connector is flush with the outer edge of the insole 4. However, it is also contemplated that the connector 10 may not be flush with the outer edge of the insole 4, but instead may be recessed into or extend out from the insole 4. In the embodiment of FIG. 2, the connector 10 is on the bottom of the insole frame construction 16, but is also contemplated that the connector 10 may be located on the top of the insole frame construction 16.

The parts of insole frame construction 16 may be made of metal, plastic, wood or wood composite, polymer, carbon fiber, rubber, fiber strands or other suitable material. In certain embodiments, the connectors 10 are integrated into the insole construction 16 during its manufacture. In other embodiments, the connectors 10 may be adhered to the insole construction 16 using adhesives such as glues, cements and the like.

Figure 3:
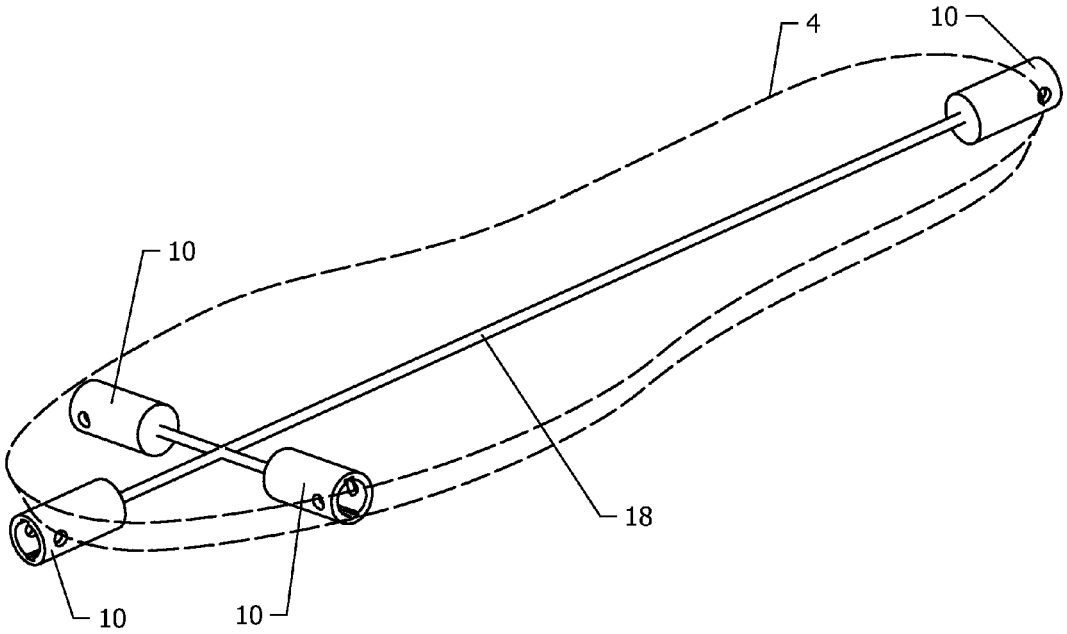
FIG. 3 is a perspective view of an assembled insole strand construction with connectors at the heel, toe and sides of the shoe.

Regarding FIG. 3, a detailed perspective view of an embodiment of an assembled insole strand construction 18 is shown. In the embodiment of FIG. 3, the insole strand construction 18 extends the entire length of the shoe, from the heel to the toe of the shoe, substantially parallel to the longitudinal axis of the shoe. A connector 10 is provided at one or both ends of the strand 18. The connector 10 can either be integral with the strand 18, such as the connector 10 and strand 18 being molded together from a plastic or formed as a metal. Or, the connector 10 can be separate from and connected to the strand 18, such as the strand 18 being plastic and the connector 10 metal, or both the strand 18 and connector 10 being metal. For instance, the strand 18 can extend into an opening in the distal end of the connector 10 and a fastener connected to the strand 18 at the inside of the connector 10. Or, the strand 18 can be a metal rod with threaded ends which are screwed into mating female openings in the connectors 10. The insole strand construction 18 of FIG. 3 may also exhibit one or more of the same embodiments as described for FIG. 2.

In another embodiment of the present invention where only one connector is used, the connector may be glued or encased within the insole 4 to fuse the connector 10 with the insole 4. The strands shown in the embodiment of FIG. 3 have a round cross-section, but the strands may be of various widths or diameters and may have different cross-sectional shapes, including circular, rectangular, square and triangle shaped cross sections.

The insole strand constructions 18 of the present invention are typically lighter than the insole frame constructions 16 of the present invention, and may allow for more flexibility in the constructed shoe. The insole frame constructions 16 of the present invention may provide for a more secure fastening between the connectors than is provided by the insole strand construction 18. The parts of the insole constructions 16 and 18 may be made of metal, plastic, wood, polymer, carbon fiber, rubber, fiber strands or other suitable material. All of the parts may be made from the same material, or they may be made of various materials within the same insole construction 16 and 18.

In alternative embodiments, the insole constructions of the present invention may be articulated, e.g. they may be made with hinges or other functionalities at certain points in the insole construction in order to provide enhanced flexibility. Hinges that may be used include ball and pin hinges and flexible hinges such as living hinges.

Figure 4:
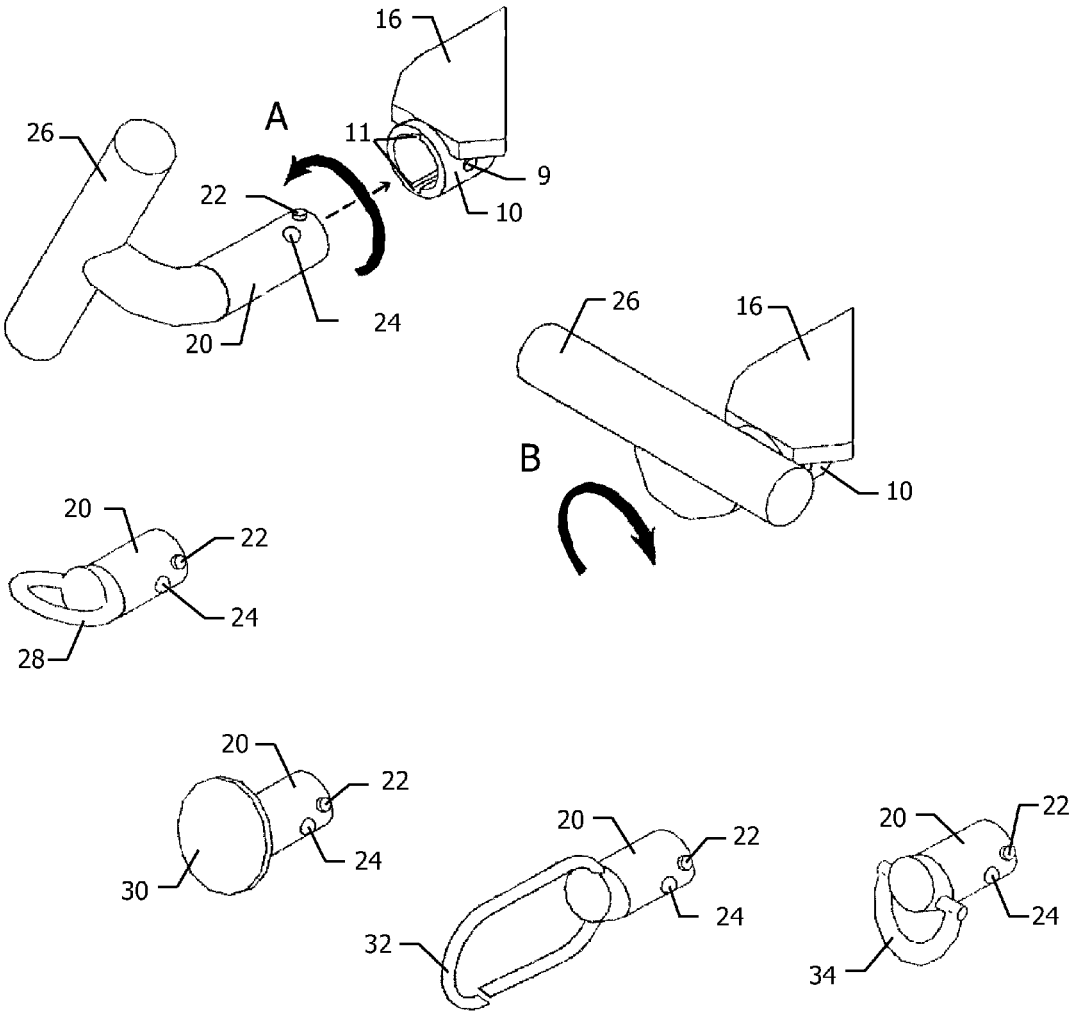
FIG. 4 is a close up perspective view of the connector with various embodiments of attachments of the present invention.

FIG. 4 shows certain embodiments of devices that may be connected to the connector 10. Although FIG. 4 shows connection to a connector 10 on the toe of the shoe, the devices described may be connected to a connector 10 located anywhere on the shoe. The devices in general may have a shaft 20 that is received by the connector 10. The shaft 20 may have one or more mating guides, each mating guide having a protruding member 22 that can align with mating grooves 11 in the connector 10 to allow for insertion and retention of the component. The shaft may also have one or more retractable members 24 that engage receiving holes 9 in the connector 10 to secure and correctly align the component to the shoe. The retractable member 24 may be supported by a spring or other mechanism capable of providing a compressible force, allowing it to be retracted while the shaft 20 is inserted into the connector 10. When the retractable member 24 aligns with the receiving hole 9, the retractable member 24 engages the receiving hole 9, causing the shaft 20 to be securely held within the connector 10. When the user of the shoe wishes to remove the component, the retractable member 24 is compressed so that it no longer engages the receiving hole 9 and the component can be removed from the connector 10.

As shown in the embodiment of FIG. 4, a turning key mechanism may be used. In the embodiment of FIG. 4, the shaft 20 is turned in the direction of arrow A so that the protruding member 22 aligns with an L or T-shaped groove 11 inside of the connector 10. The shaft is then inserted into the connector. Once the protruding member 22 is engaged with the full length of the groove, the component is turned in the direction of arrow B until the retracting member 24 engages the retaining hole 9, securely engaging the protruding member 22 within the L or T-shaped groove 11. To remove the attachment, the retracting member 24 is depressed while rotating the attachment in the opposite direction of arrow B.

It is also contemplated that other mechanisms can be used for attaching the components to the connector 10. In other embodiments, the attachment may snap into the connector and be held by a retaining mechanism. In still other embodiments of the present invention, a threaded screw mechanism may be used, e.g. the shaft 20 bears screw threads that align with threads inside the connector 10.

It is further contemplated that the connectors may have different shapes, including circular, square, rectangular, triangular and other shapes. As will of course be recognized by one of skill in the art, the shaft of the component will be shaped to be complementary to the connector, e.g. a circular cross-section to fit a circular connector.

Certain embodiments of attachments of the present invention, which may be attached to the shoe, are shown in FIG. 4. These attachments include devices such as a handle 26, an eyelet 28, a reflector 30, a hook 32, and a D-ring 34 which may also have different sizes and shapes than those shown in FIG. 4. It is also contemplated that other attachments having devices that help facilitate strength training and fitness exercise may be attached. These include other devices such as loops, including loops made of material such as rope and the like, along with clips and spikes. The attachments may be made of a variety of materials, such as metal, plastic, wood, polymer, fiber strands or carbon fiber and may be made of more than one material. The reflector attachment 30 may be made from various types of reflective materials, as are well known in the art. The attachments may be used for strength training and/or fitness exercise in various ways, such as those described below.

The reflector attachment 30 may be attached to the shoe of the present invention to make the shoe more visible in certain conditions. For example, the reflector attachment 30 may be used when running or bicycling along roads with vehicle traffic to increase the visibility of the wearer. The handle attachment 26 may be used to provide a grasping point for stretching exercises such as toe touches.

In other embodiments of the present invention, other types of elastic bands may be attached to the shoe. For example, one end of an elastic band may be attached to the shoe, for example at an eyelet 28, a hook 32 or a D-ring 34, while the other end of the elastic band has a handle for the user to hold. The user may then move their arms or legs in a manner that allows them to strengthen muscles in both the upper and lower body, including arms, legs and core musculature. Further, elastic bands attached to the shoe at one end may be attached to other attachment points at their other ends, including stationary points on a wall, floor or ceiling.

In other embodiments of the present invention, the shoes of the present invention may be used for safety purposes. For example, a climbing shoe may have attached devices that allow for the attachment of safety ropes or chains, or may have climbing spikes attached directly to the connectors of the shoe. Attachment of these types of safety devices may also be made in an embodiment of the present invention that is a work boot. For example, a person that works on a ladder or in a boom lift may wear boots according to the present invention that have attached devices which allow for the attachment of security lines that will prevent the wearer from falling.

The description of the present invention set forth herein, including the drawings, is meant to provide non-limiting description of the compositions and methods of the present invention. It should be apparent that there are variations of the present invention not explicitly presented in this specification that fall within the scope and the spirit of the invention as claimed.

What is claimed is:

1. A shoe comprising:

an insole construction comprising an interior section, said interior section comprising:

a frame extending from a toe to a heel of the shoe and defining a longitudinal axis, said frame having an outer member extending about an outer circumference of said frame, a plurality of transverse support members extending transversely across said frame and connected to the outer member at one side of the frame and at an opposite side of said frame, and a longitudinal support member extending along the longitudinal axis and connected to multiple ones of said plurality of transverse support members; and a tubular connector for receiving an attachment, wherein the connector is directly connected to the frame;

an attachment comprising:

a device; and a cylindrical shaft configured to mate with the tubular connector.

2. The shoe of claim 1, wherein the connector is located to receive the attachment at the toe of the shoe.

3. The shoe of claim 1, wherein the connector is located to receive the attachment at the heel of the shoe.

4. The shoe of claim 1, wherein the connector is located to receive the attachment at the side of the shoe.

5. The shoe of claim 1, further comprising two or more connectors configured to receive the attachment.

6. The shoe of claim 1, wherein the frame and the connector are separately constructed from at least one material selected from the group consisting of:

metal, plastic, wood, polymer, fiber strand, carbon fiber and rubber.

7. The shoe of claim 1, wherein the device is selected from the group consisting of: a handle, an eyelet, a reflector, a hook, a D-ring, a loop, a spike and a clip.

8. A shoe comprising:

an insole construction comprising an interior section, said interior section comprising:

a frame extending from a toe to a heel of the shoe and defining a longitudinal axis, said frame having an outer member extending about an outer circumference of said frame, a plurality of transverse support members extending transversely across said frame and connected to the outer member at one side of the frame and at an opposite side of said frame, and a longitudinal support member extending along the longitudinal axis and connected to multiple ones of said plurality of transverse support members; and a connector for receiving an attachment, wherein the connector is directly connected to the frame;

an attachment comprising:

a device; and a shaft capable of mating with the connector, wherein the shaft comprises a protrusion on its surface, and wherein the connector comprises a mating groove for receiving the protrusion.

9. The shoe of claim 8, wherein the connector is a tube and wherein the shaft is a cylinder capable of mating with the connector tube.

10. A shoe comprising:

an insole construction comprising an interior section, said interior section comprising:

a frame extending from a toe to a heel of the shoe and defining a longitudinal axis, said frame having an outer member extending about an outer circumference of said frame, a plurality of transverse support members extending transversely across said frame and connected to the outer member at one side of the frame and at an opposite side of said frame, and a longitudinal support member extending along the longitudinal axis and connected to multiple ones of said plurality of transverse support members; and a connector for receiving an attachment, wherein the connector is directly connected to the frame;

an attachment comprising:

a device; and a shaft capable of mating with the connector, wherein the shaft comprises a retaining member which protrudes from the shaft in a retractable manner; and wherein the connector comprises a receiving hole for receiving the retaining member.

11. A shoe comprising:

an insole construction comprising:

a first connector at a toe end of said insole;

a second connector at a heel end of said insole opposite the toe end;

a first thin, elongated strand extending from the toe end to the heel end and directly connected to the first connector and the second connector;

a third connector at a first side of said insole;

a fourth connector at a second side of said insole; and a second thin, elongated strand extending from the first side to the second side and connected to the third connector and the second connector, wherein said first strand intersects the second strand at an intersection and the first strand is connected to the second strand at the intersection.

12. The shoe of claim 11, wherein at least one connector is located to receive an attachment at the toe end of the shoe.

13. The shoe of claim 11, wherein at least one connector is located to receive an attachment at the heel end of the shoe.

14. The shoe of claim 11, wherein at least one connector is located to receive an attachment at a side of the shoe.

15. The shoe of claim 11, wherein the first strand, second strand, and the first, second, third and fourth connectors are separately constructed from at least one material selected from the group consisting of:

metal, plastic, wood, polymer, fiber strand, carbon fiber and rubber.

16. The shoe of claim 11, further comprising an attachment comprising:

a device; and a shaft capable of mating with the connector.

17. The shoe of claim 16, wherein the device is selected from the group consisting of: a handle, an eyelet, a reflector, a hook, a D-ring, a loop, a spike and a clip.

18. The shoe of claim 16, wherein at least one of the first, second, third and fourth connectors is a tube and wherein the shaft is a cylinder capable of mating with the connector tube.

19. The shoe of claim 16, wherein the shaft comprises a protrusion on its surface, and wherein at least one of the first, second, third and fourth connectors comprises a mating groove for receiving the protrusion.

20. The shoe of claim 16, wherein the shaft comprises a retaining member which protrudes from the shaft in a retractable manner; and wherein at least one of the first, second, third and fourth connectors comprises a receiving hole for receiving the retaining member.

21. The shoe of claim 1, wherein said plurality of transverse support members are integral with the outer member, and said longitudinal support member is integral with the multiple ones of said plurality of transverse support members.

* * * * *